United States Patent [19]

Maney

[11] Patent Number: 4,962,832

[45] Date of Patent: Oct. 16, 1990

[54] VEHICLE LIFT WITH LIFT LIMIT CONTROL

[75] Inventor: Jeffrey H. Maney, Rockford, Ill.

[73] Assignee: Mechanical Tool & Engineering Co., Rockford, Ill.

[21] Appl. No.: 308,012

[22] Filed: Feb. 9, 1989

[51] Int. Cl.[5] ..... B66B 1/00

[52] U.S. Cl. ..... 187/110; 187/34; 187/35; 318/466

[58] Field of Search ..... 187/34, 35, 37, 110; 318/466, 468, 470

[56] References Cited

U.S. PATENT DOCUMENTS 2,513,433 7/1950 Skow ..... 187/35

4,787,481 11/1988 Farrar et al. ..... 187/110

FOREIGN PATENT DOCUMENTS 0862128 3/1961 United Kingdom ..... 187/37

*Primary Examiner*—M. H. Paschall

*Attorney, Agent, or Firm*—Vernon J. Pillote

[57] ABSTRACT

An hydraulically operated vehicle lift having an electro-hydraulic power unit mounted on one of the lift columns for supplying fluid to the hydraulic actuator for raising the lift carriages. The electro-hydraulic power unit has an electrical junction box mounted on the motor and a manually operable switch and a lift limit control switch mounted on the junction box and electrically connected inside the box to each other and to the motor windings. The lift limit control switch is actuated by a flexible switch actuating line that has a portion extending crosswise between the lift columns at a level to be engaged by the roof of a vehicle being raised, to stop the power unit.

3 Claims, 2 Drawing Sheets

VEHICLE LIFT WITH LIFT LIMIT CONTROL

The present invention relates to hydraulically operated two-column type vehicle lifts. In some prior art hydraulically operated vehicle lifts, hydraulic power was supplied from an electro-hydraulic power unit mounted on one of the lift columns, with the power unit including pump, drive motor, a junction box mounted on the drive motor and a manually operable switch mounted on the junction box and connected to the motor for selectively operating the lift to raise the vehicle in response to actuation of the manually operable switch. The vehicle lift carriages engage the underside of the vehicle and the operator generally operates the power unit until the lift carriages raise the underside of the vehicle to a comfortable working level. However, the roof height of different types and models of vehicles varies over a wide range and, with some vehicles having high roof lines, raising of the lift carriages to position the underside of the vehicle at a desired level, can cause damage to the vehicle roof by engagement with a cross piece that extends between the lift columns, or some other overhead obstructions.

To avoid roof damage problems, some hydraulically operated lifts have heretofore been made with a limit switch mounted adjacent the upper end of the lift column, with a switch actuating rod extending crosswise of the lift at a location to engage the roof of a vehicle being raised before the roof contacts an overhead obstruction. Such an arrangement, however, complicates the problem of installing the lift, and requires electrical wiring of the remote switch to the electro-hydraulic power unit, in order to stop the power unit when the vehicle roof reaches a preselected level.

SUMMARY OF THE INVENTION

It is an object of the present invention to overcome the problems of the prior art vehicle lifts by providing an electro-hydraulic power unit for the vehicle lift having a vehicle lift limit control for stopping the lift when the roof of a vehicle on the lift is raised to a selected maximum height, and which simplifies installation of the vehicle lift.

Accordingly, the present invention provides an electro-hydraulic power unit for a two-column vehicle lift in which both a lift limit control switch and a manually operable control switch are mounted on a motor junction box attached to the motor of the electro-hydraulic power unit. The lift limit control switch and the manually operable control switch are electrically connected inside the junction box to each other and to the motor. The lift limit control switch has an actuator connected through a flexible switch operating line that extends crosswise between the lift columns at a selected height, to engage the roof of a vehicle and actuate the lift limit control switch to stop the lift when the vehicle roof reaches the selected maximum height.

DETAILED DESCRIPTION

Figure 1:
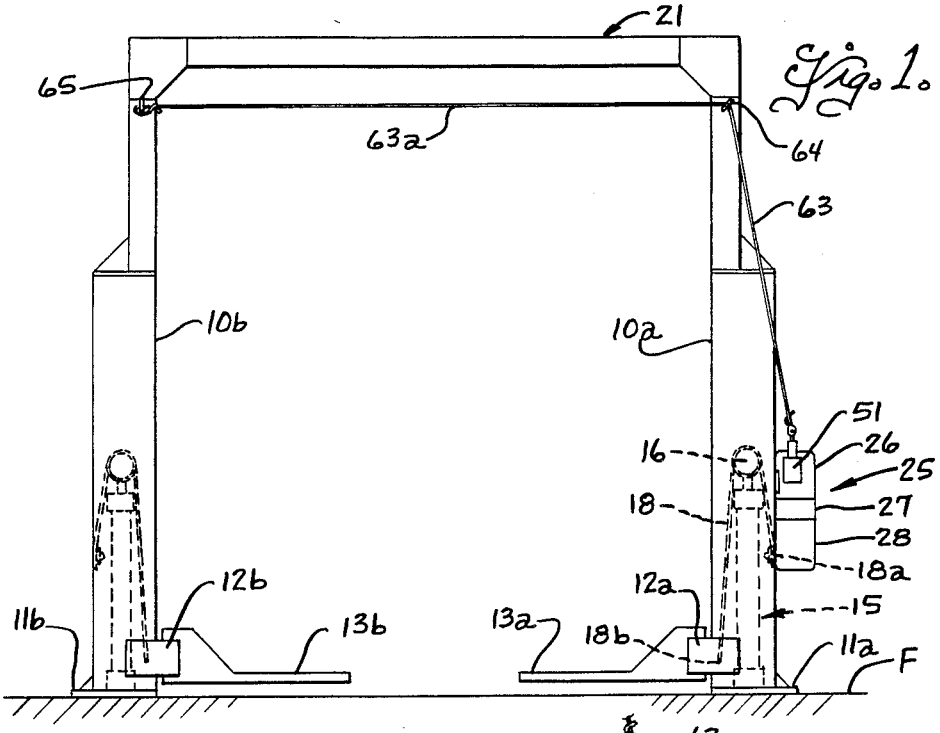
FIG. 1 is a side view of a two-column hydraulically operated lift having the present invention applied thereto.
Figure 2:
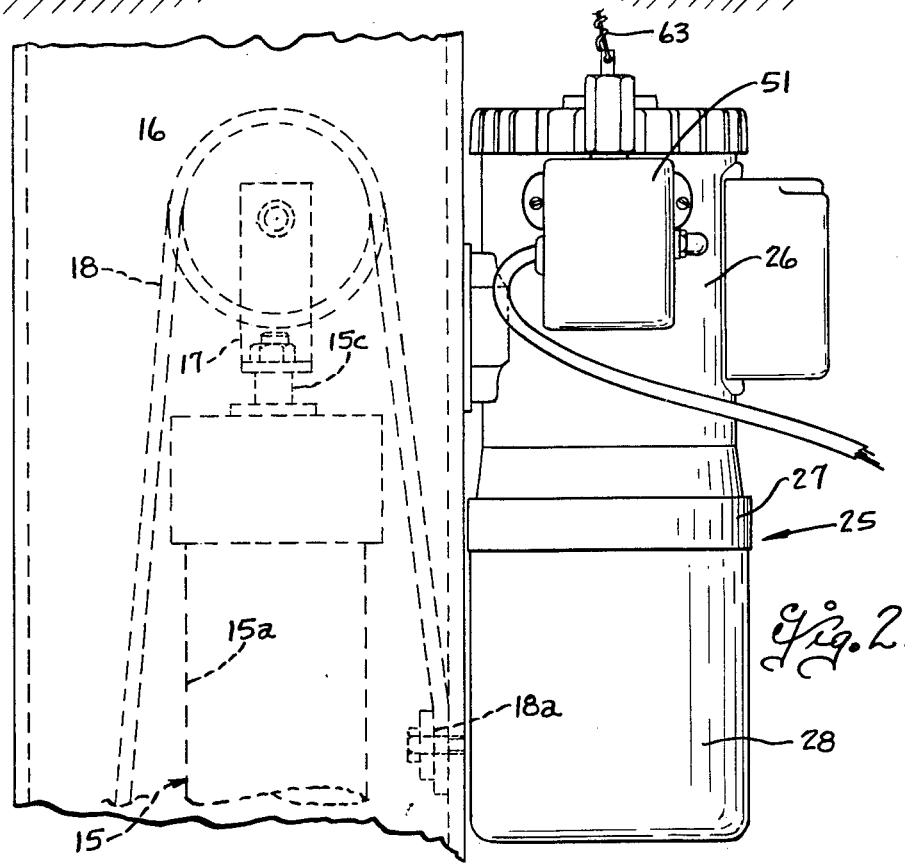
FIG. 2 is a fragmentary view illustrating the motor pump unit lift column on a larger scale than FIG. 1.
Figure 4:
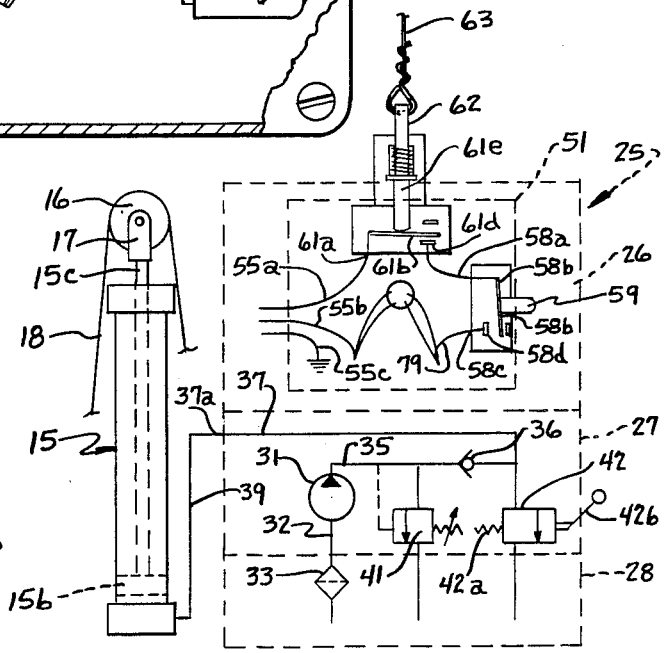
FIG. 4 is schematic electric and hydraulic diagram of the electro-hydraulic power unit and hydraulic actuator for the lift.

Referring now to FIG. 1 there is illustrated a two-column vehicle lift having spaced upright columns 10*a* and 10*b* with bases 11*a* and 11*b* at their lower ends mounted on a support floor F. Vehicle lift carriages 12*a* and 12*b* are guidably mounted on the columns 10*a* and 10*b* respectively for vertical movement therealong and vehicle engaging arms 13*a* and 13*b* are mounted on the carriages 12*a* and 12*b* for vertical movement therewith. Linear hydraulic actuator means 15 are provided in at least one and preferably both of the columns, for raising and lowering the carriages. The hydraulic actuators 15 are of conventional construction and include a cylinder 15*a* mounted at its lower end on the base of the associated column and a piston 15*b* (FIG. 4) in the cylinder with a rod 15*c* extending through the upper end of the cylinder. Any conventional arrangement may be provided for operatively connecting the piston rod to the lift carriage on the associated column and, as shown in FIGS. 1, 2, and 4, a pulley 16 is rotatably mounted on a bracket 17 fixed to the piston rod 15*c*, and a flexible member such as a chain or cable 18 has one end 18*a* fixed to a stationary structure such as the column and extends over the pulley with the other end 18*b* attached to a lift carriage such as 12*a* on the associated column. The vehicle lift can have an hydraulic actuator 15 in each of the columns as shown in FIG. 1, or a single hydraulic actuator in only one of the columns. As is conventional, the lift carriages 12*a* and 12*b* are mechanically interthe connected by cables that extend through the columns and through a cross beam 21 at the upper ends of the columns, in a manner to equalize vertical movement of the lift carriages on the columns.

Hydraulic fluid is supplied to the linear hydraulic actuators 15 from a self-contained electro-hydraulic power unit 25. As is conventional, the electro-hydraulic power unit includes an electric drive motor 26, a pump and valve assembly 27 and a reservoir 28. The motor 26 is fixed as by bolts (not shown) to the upper side of the pump and valve assembly 27, with the motor output shaft drivingly connected to a pump such as a gear pump in the motor pump assembly 27, and the reservoir 28 is attached to the lower side of the motor pump assembly. As diagrammatically shown in FIG. 4, the pump 31 has an intake line 32 that extends downwardly to an intake filter 33 immersed in the fluid in the reservoir 28. The pump has an outlet connected through a discharge passage 35 and check valve 36 to a hydraulic fluid delivery passage 37 that extends to an outlet 37*a* at one side of the pump and valve assembly 27. Outlet 37*a* is connected through an external line 39 to the hydraulic actuator 15. A pressure relief valve 41 is connected to the discharge passage 35 intermediate the pump 31 and check valve 36 and is adapted to open and bypass fluid from the pump back to the reservoir when the pressure exceeds a preselected maximum value. A manually operable two-way valve 42 in the pump and valve assembly 27 is connected to the fluid delivery passage 37 intermediate the check valve and the discharge outlet 37*a*. Valve 42 is normally biased to a closed position as by a spring 42*a*, and the valve is selectively operable to an open position by a manually operable handle 42*b* disposed externally of the pump and valve assembly 27.

Figure 3:
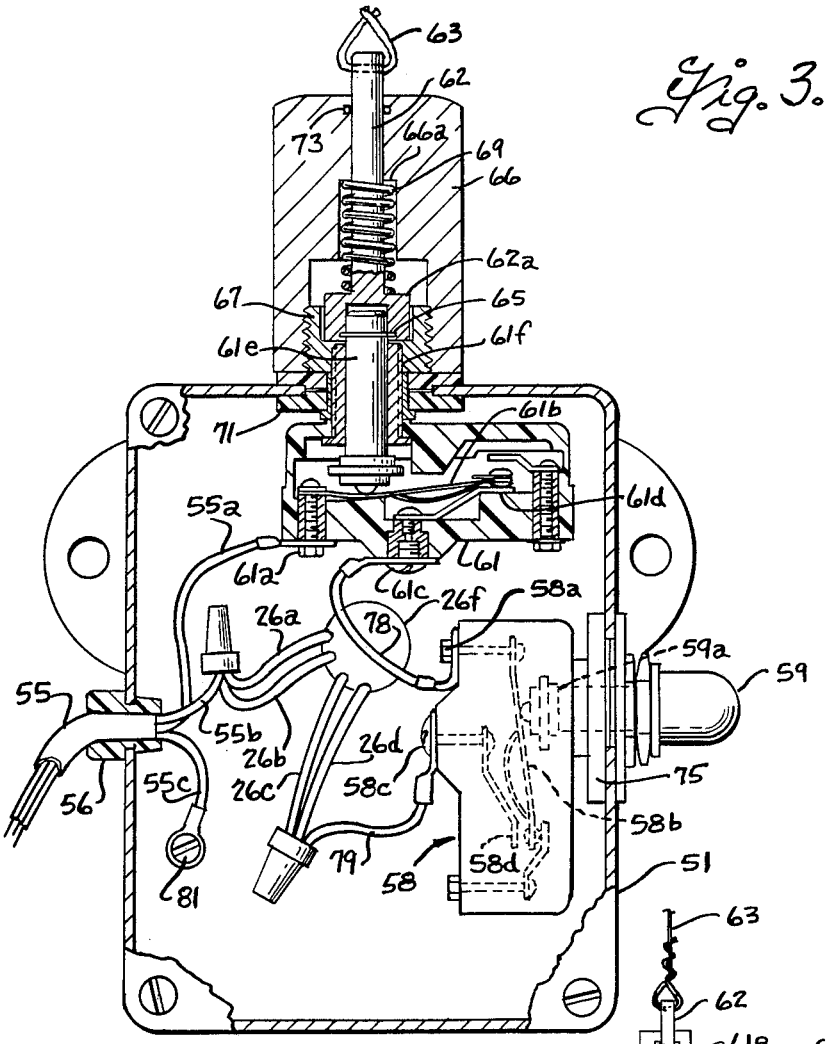
FIG. 3 is a side view of the motor electrical junction box with parts broken away and shown in section to illustrate details of construction.

An electrical junction box 51 is mounted on the side of the motor 26 and, as shown in FIGS. 3 and 4, motor conductors 26*a*, 26*b* and 26*c*,26*d* extend through an openin9 26*f* in the side of the motor and into the junction box 51. An electrical power supply line 55 extends through a grommet 56 in one side of the junction box 51, and a normally open manually operable switch 58 is mounted in the box and has a manually operable actuator 59 disposed externally of the junction box. As diagrammatically shown in FIG. 3, switch 58 is of the snap acting type and includes a first terminal 58*a* connected to the main snap spring 58*b* and a second terminal 58*c* connected to a normally open contact 58*d*. Main snap spring 58*b* is arranged so as to be normally biased away from the contact 58*d* and actuator 59 includes a plunger 59*a* arranged to engage the main snap spring, when the actuator 59 is manually operated to depress the plunger 59*a*, to operate the main snap spring to a position engaging oontaot 58*d*.

Switch 58 is electrically connected in a manner described more fully hereinafter to the motor windings and to the power supply line to energize the motor and drive the pump when the switch actuator 59 is manually operated, and the motor pump unit is mounted on one of the columns 10*a* of the lift at a location such that the switch actuator 59 is at a convenient height for manual operation. The lift arms 13*a*, 13*b* engage the underside of the vehicle and the operator generally operates the lift until the underside of the vehicle is at a convenient height for work on the vehicle. However, the roof height of different types and models of vehicles varies over a wide range and some vehicles with a high roof line may engage the cross beam 21 or some other overhead obstruction when the vehicle is raised to position the underside of the vehicle at a convenient working level. In order to prevent damage to the vehicle roof when raising the vehicle, a lift limit control is provided to stop operation of the electro-hydraulic power unit when the vehicle roof line reaches a preselected maximum elevation. In accordance with the present invention, a lift limit control switch means 61 is mounted in the motor junction box 51 that contains the manually operable switch 58 and the motor conductors, and the switch 61 is electrically connected inside the junction box in series with the switch 58 and to the motor conductors and power supply conductors, to interrupt the supply of power to the motor when the control switch 61 is actuated. A switch actuator 62 is disposed externally of the junction box and a flexible switch operating line such as a thin cable or cord 63 is connected to the switch actuator and (as shown in FIG. 1) has a portion 63a that extends crosswise between the columns adjacent their upper ends at a location to engage the roof of a vehicle being raised before the roof engages the cross beam 21 or other overhead obstruction. As shown in FIG. 1, the switch operating line 63 extends upwardly from the switch actuator and through a guide such as a eyelet 64 adjacent the upper end of the column 10*a*, and then crosswise between the columns to an anchor 65 on the other column 10*b*.

Switch 61 is preferably of the snap acting type and includes a first terminal 61*a* connected to the fixed end of the main snap spring 61*b*, and a second terminal 61*c* connected to the normally open contact 61*d*. The main snap spring 61*b* is arranged to normally bias the snap spring away from contact 61*c* and a plunger 61*e* is mounted in a ferrule 6lf on the switch housing at a location to engage the snap spring 61*b* and move the snap spring into engagement with contact 61*c* when the plunger is depressed. Switch 61 is preferably mounted on the top wall of the junction box with the plunger 61*e* arranged for reciprocation along a vertical path. The actuator 62 has a head 62*a* at its lower end that is keyed as by a split ring 65 to the plunger 61*e*, for movement therewith, and the actuator 62 is slidably supported in a guide block 66 that is connected by an adapter bushing 67 to the ferrule 61f on the switch 61. Adapter fitting 67 has an internally threaded bore that is threadedly connected to the ferrule 61*f*, and external threads that engage an internally threaded opening in the actuator guide block 66. A compression spring 69 is interposed between a shoulder 66a on the guide block 66 and the head 62*a* on the actuator 62 and the spring 69 is arranged to normally press the actuator downwardly with sufficient force to depress the plunger 61*e* and move the main snap spring 61*b* to a position engaging the normally open contact 61c. Thus, spring 69 is arranged to actuate the switch 61 to a position engaging the normally open contact 61*c* when the tension in the switch operating line 63 is below a preselected value, and when the tension in the operating line is increased, as would occur if a vehicle roof engaged the portion 63*a*, the line pulls the actuator 62 upwardly and raises the switch plunger 61*e*, to allow the snap spring to move away from contact 61*c* to a normally open condition. As shown in FIG. 3, seal washers 71 of resilient material such as plastic, rubber or the like are interposed between the adapter fitting 67 and the junction box to seal the opening around the ferrule. A seal such as an O-ring 73 is provided in the guide bore of the guide block 66, to form a sliding seal with the actuator 62. Seal washers 75 are also provided for sealing the interface between the switch 58 and the housing, and the switch actuator 59 also advantageously includes a resilient seal cover to inhibit entrance of moisture and foreign material to the switch and junction box.

As best shown in FIGS. 3 and 4, the power supply line includes a first conductor 55a connected to terminal 61*a* of switch 61, and terminal 61*c* of switch 61 is connected through a conductor 78 to terminal 58*a* of switch 58. Terminal 58*c* of switch 58 is connected through a conductor 79 to motor winding conductors 26*c* and 26*d*, and the other motor winding conductors 26*a* and 26*b* are connected through a second power supply conductor 55*b*. power supply line 55 also preferably includes a ground wire 55*c* which is connected as at 81 to the motor housing.

From the foregoing it is thought that the construction and operation of the vehicle lift and lift controls will be readily understood. The lift limit switch 61 and manually operable switch 58 are assembled on the motor junction box 51 and wired to each other and to motor windings. Accordingly, when installing the vehicle lift, it is only necessary to mount the electro-hydraulic power unit on the column and then run the flexible switch actuating line 63 over guide 64 to the line anchor 65. Line 63 is anchored so that it is normally under little or no tension and switch actuator 62 is normally biased downwardly by spring 69 to actuate the lift limit switch 61 into engagement with its normally open contact. Thus, when manually operable switch is operated, it will energize the drive motor 25 through the switch 61, to drive the pump 31 and supply fluid under pressure to the hydraulic actuator 15. If the portion 63*a* of the switch actuating, line is engaged by the roof of a vehicle before the actuator 59 of the manually operable switch 58 is released, the line 63 will be tensioned until it overcomes spring 69 to thereby raise the actuator 62 and move the switch actuating plunger 61*e* and allow the snap spring 61b to move to its normally open position away from contact 61c to deenergize the motor. When the motor is deenergized, check valve 36 closes and prevents return flow from the fluid actuator 15, to hold the lift in a raised position. Manually operable valve 42 can be selectively operated by handle 42b to pass fluid from delivery passage 37 back to the reservoir 28, and allow the fluid actuator to move downwardly to a lower position.

The embodiments of the invention in which an exclusive property or privilege is claimed are defined as follows:

1. In a hydraulically operated vehicle lift including a pair of spaced upright columns, vehicle lift carriage means mounted for vertical movement on the columns, means including a linear hydraulic actuator means on at least one column for raising and lowering the vehicle lift carriage means, an electro-hydraulic power unit mounted on one column, the power unit including pump means hydraulically connected to the linear hydraulic actuator means, electric motor means drivingly connected to the pump means and having motor conductors, a junction box mounted on the motor pump unit with the motor conductors extending thereinto, and a control switch means mounted in the junction box and operable between a conducting and a non-conducting condition, manually operable control switch actuator means external of the junction box for selectively operating control switch means from a non-conducting to a conducting condition, the improvement comprising a second switch means mounted in the junction box and operable between a conducting and non-conducting condition, second switch actuator means external of the junction box, the second switch means and said control switch means being electrically connected inside the junction box in a circuit with said motor conductors to energize the motor means only when both switch means are in a conducting condition, and flexible switch operating line means having one end connected to the second switch actuator means, said switch operating line means having a portion extending crosswise between the pair of columns at a selected height for engagement with a vehicle being lifted, the second switch means and the second switch actuator means being arranged to operate the second switch means to a conducting condition when the tension in the switch operating line is below a preset value and to a non-conducting condition when the tension in the switch operating line exceeds said preset value.

2. In a hydraulically operated vehicle lift including a pair of spaced upright columns, vehicle lift carriage means mounted for vertical movement on the columns, means including a linear hydraulic actuator means on at least one column for raising and lowering the vehicle lift carriage means, an electro-hydraulic power unit mounted on one column, the power unit including pump means hydraulically connected to the linear hydraulic actuator means, electric motor means drivingly connected to the pump means and having motor conductors, a junction box mounted on the motor pump unit with the motor conductors extending thereinto, and a control switch means mounted on the motor pump unit with the motor conductors extending thereinto, and a control switch means mounted in the junction box and operable between a conducting and a non-conducting condition, manually operable control switch actuator means external of the junction box for selectively operating control switch means from a non-conducting conducting to a conducting condition, the improvement comprising a second switch means mounted in the junction box and operable between a conducting and non-conducting condition, second switch actuator means external of the junction box, the second switch means and said control switch means being electrically connected inside the junction box in a circuit with said motor conductors to energize the motor means only when both switch means are ina conducting condition, and flexible switch operating line means having one end connected to the second switch actuator means, said switch operating line means having a portion extending crosswise between the pair of columsn at a selected height for engagement with a vehicle being lifted, the second switch means and the second switch actuator means being arranged to operate the second switch means to a conducting condition when the tension in the switch operating line is below a preset value and to a non-conducting condition when the tension in the switch operating line exceeds said preset value, said second switch actuator means including plunger means mounted for reciprocation along a generally upright path, spring means yieldably biasing the plunger means downwardly to operate the second switch means to the conducting condition, the flexible switch operating line means being connected to the plunger means.

3. In a hydraulically operated vehicle lift including a pair of spaced upright columns, vehicle lift carriage means mounted for vertical movement on the columsn, means including a linear hydraulic actuator means on at least one column for raising and lowering the vehicle lift carriage means, an electro-hydraulic power unit mounted on one column, the power unit including pump means hydraulically connected to the linear hyudraulic actuator means, electric motor means drivingly connected to the pump means and having motor conductors, a junction box mounted on the motor pump unit with the motor conductors extending thereinto, and a control switch means mounted in the junction box and operable between a conducting and a non-conducting condition, manually operable control switch actuator means external of the junction box for selectively operating control switch means from a non-conducting to a conducting condition, the improvement comprising a second switch means mounted in the junction box and operable between a conducting and non-conducting condition, second switch actuator means external of the junction box, the second switch means and said control switch means being electrically connected inside the junction box in a circuit with said motor conductors to energize the motor means only when both switch means are in a conducting condition, and flexible switch operating line means having one end connected to the second switch actuator means, said switch operating line means having a portion extending croswise between the pair of columsn at a selected height for engagement with a vehicle being lifted, the second switch means and the second switch actuator means being arranged to operate the second switch means to a conducting condition when the tension in the switch operating line is below a preset value and to a non-conducting condition when the tension in the switch operating line exceeds said preset value, said second switch means being normally in a non-conducting conditino and having a plunger actuator operative when depressed to operat ethe second switch means to the conducting condition, said second switch actuator means including plunger means mounted for reciprocation along a generally upright path aligned with the plunger actuator, spring means yieldably biasing the plunger means downwardly to depress the plunger actuator of the second switch means and operate the second switch means to a conducting condition, the flexible switch operating line means being connected to the plunger means to move the plugner means upwardly when the tension in the flexible switch operating line means exceeds said preset value to allow the second switch means to return to its normal non-conducting condition.

* * * * *

UNITED STATES PATENT AND TRADEMARK OFFICE

CERTIFICATE OF CORRECTION

PATENT NO. : 4,962,832

DATED : Oct. 16, 1990

INVENTOR(S) : Jeffrey H. Maney

It is certified that error appears in the above-identified patent and that said Letters Patent is hereby corrected as shown below:

COLUMN 5, line 62, delete "mounted on the motor";
line 63, delete "pump unit with the motor conductors extending there-";
line 64, delete "into, and a control switch means"

COLUMN 6, line 1, delete "conducting" (second occurrence);
line 9, delete "ina" and enter -- in a --;
line 14, delete "lumsn" and enter -- lumns --;
line 30, delete "columsn" and enter -- columns --;
line 56, delete "croswise" and enter -- crosswise --
line 57, delete "columsn" and enter -- columns --;
line 65, delete "conditino" and enter -- condition --;
line 66, delete "operat" and enter -- operate --;
line 67, delete "ethe" and enter -- the --

COLUMN 8, line 2, delete "plugner" and enter -- plunger --.

Signed and Sealed this

Seventh Day of January, 1992

*Attest:*

HARRY F. MANBECK, JR.

*Attesting Officer*

*Commissioner of Patents and Trademarks*